United States Patent [19]

King

[11] Patent Number: 4,474,126

[45] Date of Patent: Oct. 2, 1984

[54] SAILING RIG

[76] Inventor: Bruce P. King, Paradise Point, East Boothbay, Me. 04544

[21] Appl. No.: 420,134

[22] Filed: Sep. 20, 1982

[51] Int. Cl.[3] ..... B63H 9/06

[52] U.S. Cl. ..... 114/102; 114/39; 114/90; 114/98

[58] Field of Search ..... 114/39, 90, 91, 102, 114/103, 106, 105, 92, 98; 280/810

[56] References Cited

U.S. PATENT DOCUMENTS

| | | | |
|---|---|---|---|
| 3,340,841 | 9/1967 | Brazier | 114/39 |
| 3,598,075 | 8/1971 | Kenney | 114/102 |
| 4,367,688 | 1/1983 | Godfrey | 114/39 |

FOREIGN PATENT DOCUMENTS

| | | | |
|---|---|---|---|
| 7901568 | 8/1980 | Netherlands | 114/106 |

*Primary Examiner*—Trygve M. Blix
*Assistant Examiner*—Patrick W. Young
*Attorney, Agent, or Firm*—William Nitkin

[57] ABSTRACT

A sailing rig for use on a sailboat comprising a sail formed in the shape of two approximately ellipsoidal portions with a free-standing mast being rotatable on its vertical axis, the mast being curved near its top from the vertical axis of rotation of the mast so that the sail, when the sailboat is close-hauled, folds around the mast and when the sailboat runs before the wind, the sail unfolds and opens to fly free of the mast.

4 Claims, 3 Drawing Figures

SAILING RIG

BACKGROUND OF THE INVENTION

This invention relates to a sailing rig for a sailboat and more particularly relates to a sailing rig utilizing a foldable sail in conjunction with a rotating curved mast.

HISTORY OF THE PRIOR ART

Sailing rigs over the years have been the subject of intense study and development to provide optimal sail configuration for any apparent wind direction. One area of development in sail and rig design has been the providing of a single mast to which are attached twin sails which pass around the mast. When going to the windward, these two sails lie together and act as one. When running before the wind, the two sails are separated and "goose-winged" with their ends held by a boom on each clew yielding a sail area double the close-hauled sail area. In one embodiment disclosed in *Sail Theory and Practice* by C. A. Marchaj (1964) pages 99–100, FIG. 64 reefing is effected by rotating the mast and rolling both sails onto it. In another prior art embodiment called the "butterfly rig" in use in 1977, the triangular sail of the above embodiment is utilized affixed to the mast only at its top and at its clews to twin booms while not being attached at other points to the mast so as to fly free therefrom.

It is well known that when one sails close to the wind, the apparent wind is increased over that of the true wind speed. When sailing before the wind, the apparent wind speed is less than the true wind speed, being reduced by the boat speed. This difference in apparent wind speed, depending upon course, combined with the direction of said forces interacting with hull forces, make it generally desirable for a boat to approximately double her close-hauled sail area when sailing before the wind. Unfortunately the prior art sailing rigs embodying the design mentioned above capable of doubling its area by unfolding a two-part sail is seriously compromised by an approximately triangular profile and a less than optimal sectional shape.

SUMMARY OF THE INVENTION

It is an object of this invention to provide a sailing rig comprised of a single sail and associated mast which are capable of extreme changes of geometry and area in order to realize near-optimal configurations for any apparent wind direction.

This invention utilizes a sail similar to a spinnaker for sailing before the wind and which subsequently folds around a free-standing and rotating curved mast when sailing closer to the wind.

DESCRIPTION OF THE PREFERRED EMBODIMENT(S)

Figure 2:
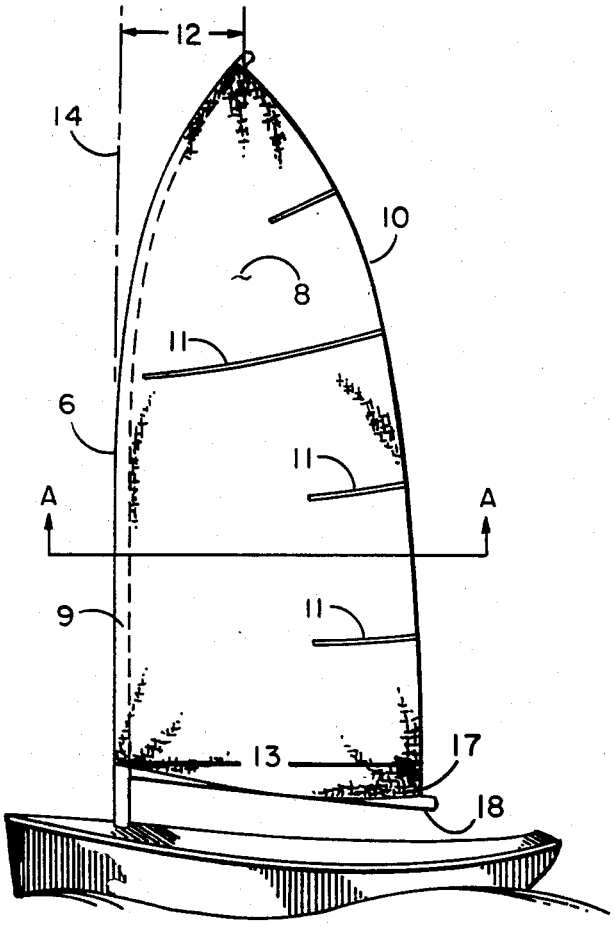
FIG. 2 is a view of the sailing rig of this invention close-hauled with the sail folded around the mast which is facing in a rearward position.
Figure 1:
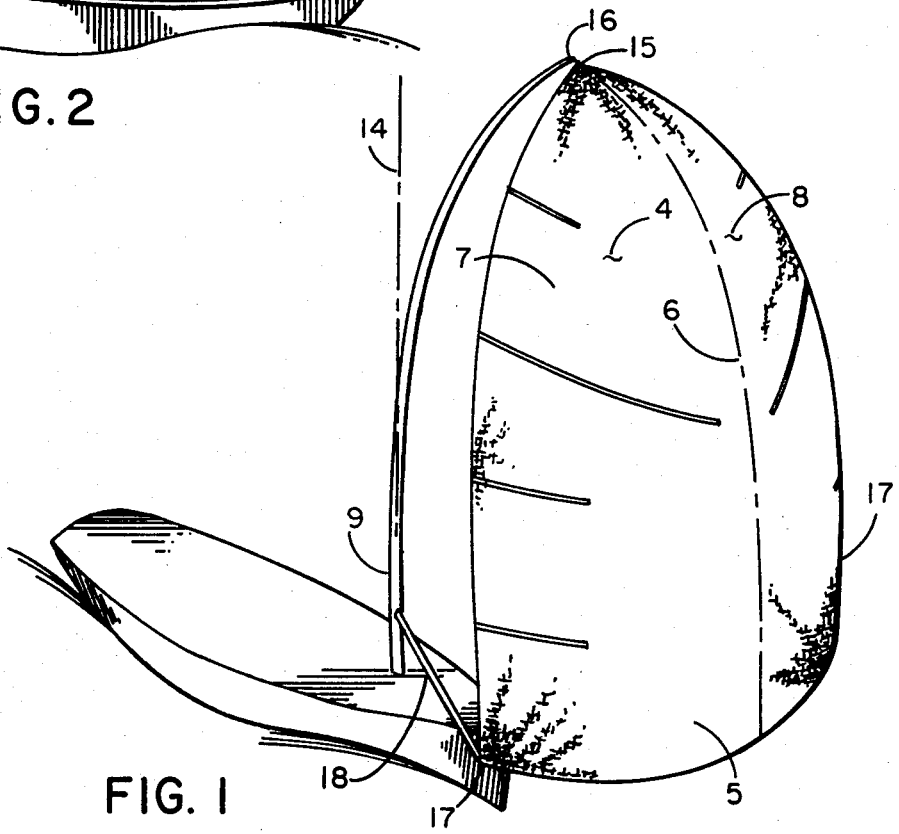
FIG. 1 is a view of the sailing rig of this invention running before the wind with the mast in a forward-facing position.

FIG. 1 illustrates the sailing rig of this invention used before the wind. The current state of the art for sailing before the wind utilizes parachute spinnakers. These spinnakers can be adapted for use on the sailing rig of this invention. Such a sail has an approximately spherical top 4 and a cylindrical bottom 5 and when folded vertically along its center line 6, it forms approximately two ellipsoidal-shaped segments 7 and 8. When the rig is used to sail close-hauled, the sail folds around the mast with segments 7 and 8 forming a sail of approximately half the area of that when used sailing before the wind as shown in FIG. 2. The mast 9 is adapted to be free-standing and to rotate and has a curved upper portion which fits the profile of the sail when folded thereon. In practice when one sails close-hauled as seen in FIG. 2, the mast curve faces aft and its shape accommodates the shape of the sail. When the boat turns before the wind, the sail balloons out spreading apart and the mast 9 rotates so that its curved portion faces forward holding the sail away from the mast. The head of the sail 15 may be attached to the mast by a halyard exiting through a fairlead at the masthead 16 allowing the halyard to rotate through a full circle. On a smaller boat the halyard may be omitted and the head of the sail 15 can be attached to a short lanyard or other swiveling device that allows full rotation. The rotation of the mast can be accomplished by well-known means in the art. The mast should rotate freely so as to accommodate movement of the sails caused by various wind directions. The clews of the sail can be connected to the boom(s) 18 when in the folded condition; and when the sail is flown free of the mast, one clew can be left attached to the boom and the other flown free; or one clew can be sheeted to the boom and the other attached to a spinnaker pole in a conventional fashion; or the clews can be attached to twin booms. When the sail is folded around the mast, the foot of the sail at its center line can be attached to a down-haul line that is used for tensioning the luff of the sail. The relatively large amount of roach curve 10 of the sail of each segment can be supported in the conventional manner with a series of battens 11 arranged in any suitable configuration.

Figure 3:
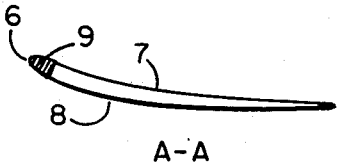
FIG. 3 is a top view of the mast and sails through section A—A of FIG. 2.

The amount of mast curve 12 which may be permanent may vary, but the optimum is to position the top of the mast approximately one-half of the foot length of the sail when folded 13, from the vertical axis of rotation 14 of the mast. When the mast is used in the folded sail condition as seen in FIGS. 2 and 3, its alignment about its vertical axis of rotation 14 is controlled by the direction of tensions in the leech of sail 10. When the mast is used in the unfolded spinnaker condition as seen in FIG. 1 with the sail flying free from the mast, the alignment of the curved mast about its vertical axis is controlled by the direction of pull at the head of sail 15. This means that in this condition the mast will have rotated about its vertical axis 14 to a generally forward-facing position, locating the masthead 16 well forward of the vertical axis of the mast. Heretofore with conventional straight or nearly straight masts, positioning of the top of the mast to a location forward of the mast's vertical axis had to be accomplished by additional procedures that generally lean the entire mast forward. With the curved rotating mast of this invention, the forward displacement of the masthead 16 while operating under spinnaker is automatic. This forward displacement of the masthead 16 has two benefits. The first benefit is a general improvement in the boat's directional stability and balance. Forward movement of the sail forces while sailing under spinnaker tend to reduce the tendency of the boat to round up into the wind. The second benefit is that by positioning the head of the spinnaker 15 forward in relation to its clews 17, the spinnaker is allowed to hang in position, reducing the tendency of it to collapse against the mast from its own weight in very light winds.

When the sail is folded back around the mast and used in the windward condition as seen in FIGS. 2 and 3, the configuration derived therefrom offers a high degree of aerodynamic efficiency. First, the double luff effect of the wraparound sail presents a smooth leading edge on both sides, eliminating mast interference. Secondly, the nearly elliptical profile as seen in FIG. 2 has been shown to exhibit superior aerodynamic characteristics over the usual triangular platform, particularly reducing induced drag.

Although the present invention has been described with reference to particular embodiments, it will be apparent to those skilled in the art that variations and modifications can be substituted therefor without departing from the principles and spirit of the invention.

I claim:

1. A sailing rig for use on a sailboat comprising:

a sail formed in the shape of two approximately ellipsoidal portions;

a free-standing mast, being rotable on its vertical axis;

said mast being straight at its lower portion and curved from the vertical axis of rotation at its top; and said sail, when said boat is close-hauled, folds around said mast; and when said boat is before the wind, said sail unfolds and opens to fly free of said mast, the curved top of said mast displacing the top of said sail forward of the vertical axis of the straight lower portion of the mast.

2. The sailing rig of claim 1 wherein said mast is curved more than 25% of the folded sail foot length from the vertical axis of rotation of said mast.

3. The sailing rig of claims 1 or 2 wherein said mast is permanently curved.

4. A method of sailing a sailboat using a spinnaker-type sail and a rotating free-standing mast having a vertical axis, comprising the steps of:

curving the upper portion of said mast;

rotating said mast so that its curved upper portion extends aft;

folding said sail around said mast when sailing into the wind;

rotating said mast with the curved upper portion of said mast being at a forward-extending position when sailing before the wind;

opening said folded sail by separating the folded portions;

flying said sail free in front of said mast; and displacing the top of said sail forward from said vertical axis of said mast at least the distance of said curve of the upper portion of said mast from the vertical axis of said mast.

* * * * *